US009296517B2

(12) United States Patent
Hall

(10) Patent No.: US 9,296,517 B2
(45) Date of Patent: Mar. 29, 2016

(54) ADJUSTABLE BOX TOP LID

(71) Applicant: Buddeez, Inc., Wentzville, MO (US)

(72) Inventor: Charles E. Hall, Wentzville, MO (US)

(73) Assignee: Buddeez, Inc., Wentzville, MO (US)

( * ) Notice: Subject to any disclaimer, the term of this patent is extended or adjusted under 35 U.S.C. 154(b) by 72 days.

(21) Appl. No.: 14/242,099

(22) Filed: Apr. 1, 2014

(65) Prior Publication Data

US 2015/0274379 A1 Oct. 1, 2015

(51) Int. Cl.

| | |
|---|---|
| ***B65D 8/00*** | (2006.01) |
| ***B65D 21/08*** | (2006.01) |
| ***B65D 43/02*** | (2006.01) |
| ***B65D 47/08*** | (2006.01) |

(52) U.S. Cl.

CPC ..... *B65D 21/086* (2013.01); *B65D 43/0218* (2013.01); *B65D 47/0895* (2013.01); *B65D 21/08* (2013.01); *B65D 2543/00194* (2013.01); *B65D 2543/00231* (2013.01); *B65D 2543/00296* (2013.01); *B65D 2543/00555* (2013.01)

(58) Field of Classification Search

CPC ..... B65D 47/0847; B65D 2251/08; B65D 43/20; B65D 88/005; B65D 21/086; B65D 21/068; B65D 33/007; B65D 33/24; B65D 21/08; B65D 43/021; B65D 2543/00194

USPC ..... 220/254.3; 249/157; 229/125.09, 229/125.14

See application file for complete search history.

(56) References Cited

U.S. PATENT DOCUMENTS

| | | | | | |
|---|---|---|---|---|---|
| 2,030,134 | A | * | 2/1936 | Burgener | 229/125.12 |
| 2,102,094 | A | * | 12/1937 | Romig | 220/351 |
| 2,255,225 | A | * | 9/1941 | Meggy | 222/192 |
| 2,585,923 | A | * | 2/1952 | Epler et al. | 206/246 |
| 2,627,801 | A | | 2/1953 | Danziger | |
| 3,110,436 | A | * | 11/1963 | Wagner | 229/125.14 |
| 3,692,230 | A | * | 9/1972 | Kapiloff | 229/125.06 |
| 4,564,118 | A | | 1/1986 | Heyer et al. | |
| 4,759,478 | A | * | 7/1988 | Richardson | B65D 47/0847 206/508 |
| 5,211,305 | A | * | 5/1993 | Horton | 229/117.27 |
| 5,884,800 | A | * | 3/1999 | Hall | B65D 25/16 220/495.03 |
| 8,132,690 | B2 | | 3/2012 | Hall et al. | |

(Continued)

OTHER PUBLICATIONS

International Search Report and Written Opinion from co-pending PCT Application No. PCT/US15/23601, filed Mar. 31, 2015.

*Primary Examiner* — Mickey Yu
*Assistant Examiner* — Gideon Weinerth
(74) *Attorney, Agent, or Firm* — Joseph M. Rolnicki; Evans & Dixon, L.L.C.

(57) ABSTRACT

An adjustable box top lid is removably attachable to each container of a plurality of separate containers with each container having a rectangular top opening with a length dimension that is different from length dimensions of the top openings of the other containers of the plurality of containers. The adjustable lid includes first and second separate sections that are connected together and are movable relative to each other when connected to adjust a length of the lid. The adjustable length of the lid enables the lid to be removably attachable to each of the containers over the rectangular top opening of each container. One of the lid sections is provided with an opening and a removable cap over the opening that can be removed to allow the dispensing of food products from the container to which the lid is attached.

13 Claims, 14 Drawing Sheets

(56) References Cited

U.S. PATENT DOCUMENTS

| | | | | |
|---|---|---|---|---|
| 8,235,246 | B2 | 8/2012 | Hall et al. | |
| 8,668,123 | B2 * | 3/2014 | Richmond | 224/312 |
| 2004/0206757 | A1 * | 10/2004 | Hall | B65D 47/0847 220/254.3 |
| 2006/0010659 | A1 * | 1/2006 | Penn | B65D 33/007 24/273 |
| 2006/0118607 | A1 * | 6/2006 | Meert | 229/125.09 |
| 2006/0191937 | A1 * | 8/2006 | Shai | 220/287 |
| 2007/0012696 | A1 * | 1/2007 | Levie | 220/8 |
| 2008/0202976 | A1 * | 8/2008 | Burgess et al. | 206/558 |
| 2012/0223074 | A1 * | 9/2012 | Porter, Jr. | A47J 47/06 220/254.3 |
| 2015/0175328 | A1 * | 6/2015 | Anthony | B29D 99/0096 220/287 |

* cited by examiner

ADJUSTABLE BOX TOP LID

FIELD OF INVENTION

The present invention that is directed to an adjustable lid that is removably attachable to each container of a plurality of separate containers with each container having a rectangular top opening with a length dimension that is different from length dimensions of the top openings of the other containers of the plurality of containers. The adjustable lid includes first and second separate sections that are connected together and are movable relative to each other when connected to adjust a length of the lid. The adjustable length of the lid enables the lid to be removably attachable to each of the containers over the rectangular top opening of each container. One of the lid's sections is provided with an opening and a removable cap over the opening that can be removed to allow the dispensing of food products from the container to which the lid is attached.

DESCRIPTION OF THE RELATED ART

Food products such as breakfast cereals, crackers and snack foods have long been packaged in hermetically sealed bags that are contained in cardboard boxes. Perhaps the most familiar food product contained in the sealed bag in a cardboard box is breakfast cereal.

Breakfast cereals are offered to consumers in a variety of different package sizes. In opening a new package of breakfast cereal the box is typically opened by pulling apart and folding back four flaps at the top of the box. The hermetically sealed bag in the box is then opened at the top of the bag. After the desired amount of cereal is dispensed from the package the bag is usually folded over or rolled up to reseal the bag. The flaps of the box are folded over and a tab on one of the larger box flaps is inserted into a slot or under an edge indentation in the opposite box flap to close the box. Each time it is desired to dispense a certain amount of breakfast cereal from the package it is necessary to pull apart and fold back the four box flaps, unroll or unfold the top of the bag in the box before dispensing the desired amount of cereal, fold or roll up the top of the bag after the desired amount of cereal has been dispensed and then fold over the box flaps and engaging the flap tab and flap slot or flat tab and flat edge indentation to close the box.

The above steps taken to open and close the packaging of breakfast cereal can at times become tedious. What would overcome this problem is a lid that could be attached to the open top of the breakfast cereal box where the lid has a cap that is easily opened when it is desired to dispense an amount of serial from the box and closed after the amount of serial has been dispensed. However, as stated above, breakfast cereal packaging comes in a variety of different sizes. The boxes employed in packaging breakfast cereal are typically rectangular in shape. The box tops of the different size boxes are defined by pairs of opposite side walls of the boxes that have short lengths and pairs of opposite front and rear walls of the boxes that have longer lengths than the side walls. The dimensions of the opposite front and rear walls of the different sizes of breakfast cereal boxes differ substantially. The dimensions of the opposite side walls of the different sizes of breakfast cereal boxes are not significantly different when compared to the differences in lengths of the front and rear walls. Thus, to provide a removable lid that would be removably attached to the open top of a breakfast cereal box to facilitate dispensing cereal from the box through the opened lid and then closing the lid after the desired amount of cereal was dispensed would require several lids with different dimensions to fit the open top of the various different sizes of breakfast cereal boxes.

SUMMARY OF THE INVENTION

The disadvantages discussed above are overcome by the adjustable box top lid of the present invention that is designed to be removably attached to the top opening of each of the variety of different size boxes that are presently employed in packaging breakfast cereal.

In preparation for the use of the adjustable box top lid of the invention, the packaging of the breakfast cereal is first opened by opening the box top and folding over the closure flaps of the box top. The hermetic bag containing the breakfast cereal inside the box is opened at the top of the bag. The packaging of the breakfast cereal is then prepared for use with the adjustable box top lid.

As stated earlier, the various different sizes of breakfast cereal boxes have opposite short side walls and longer front and rear walls that are longer than the side walls. The length dimensions of the opposite front and rear walls of various different sizes of breakfast cereal boxes differ substantially. The length dimensions of the side walls of the various different sizes of cereal boxes are not substantially different when compared with the differences in the length dimensions of the front and rear walls.

The adjustable box top lid is designed to fit over the open box top of the many different sizes of breakfast cereal packaging boxes. The lid has first and second separate sections that are connected together and are movable relative to each other when connected to adjust a length of the lid. The adjustable length of the lid enables the lid to fit over the top opening of each container of a plurality of separate containers where the length dimension of the top opening of each container is different from the length dimensions of the openings of the other containers.

The first section of the lid has a rectangular first panel with opposite left and right edges and opposite front and rear edges. The edges surround the first panel and separate a top surface of the first panel from an opposite bottom surface of the first panel. The first section also has left and right side panels that extend outwardly from the first panel bottom surface and extend along the respective left and right edges of the first panel. The first section also includes a front panel that extends outwardly from the first panel bottom surface and extends along the front edge of the first panel. The first panel has a width dimension between the left and right edges and the left and right side panels that is dimensioned to enable the first panel to fit over the top opening and one of the side walls of each container of the plurality of separate containers. An opening is provided through the first panel. A cap is removably attached on the first panel top surface over the opening.

The second section of the lid has a rectangular second panel with opposite left and right edges and opposite front and rear edges. The edges surround the second panel and separate a top surface of the second panel from an opposite bottom surface of the second panel. The second section also has left and right side panels that extend outwardly from the second panel bottom surface along the respective left and right edges of the second panel. The second section also has a rear panel that extends outwardly from the second panel bottom surface along the rear edge of the second panel. The second panel has a width dimensioned between the left and right edges and the left and right side panels that is dimensioned to enable the second panel to fit over the top opening and the other side wall of each container of the plurality of separate containers.

The lid first and second sections are connected together for relative movement of the first and second sections. The connected first and second sections are moveable along the length of the lid with the first panel bottom surface sliding over the second panel top surface. The relative movement of the lid first and second sections enables adjusting the length of the lid. The adjustable length of the lid enables the lid to fit over the top opening of each container of the plurality of containers with the first panel front edge and the front panel and the second panel rear edge and the rear panel extending over opposite side walls of the container top opening and with the left side panels of the first and second sections and the right side panels of the first and second sections extending over the respective front and rear walls of the container.

Thus, the adjustable box top lid of the present invention provides a lid that can be removably attached to the opened box top of breakfast cereal packaging boxes of various different sizes where the lid can be easily opened to dispense the desired amount of breakfast cereal from the box and then can be easily closed to preserve the breakfast cereal.

BRIEF DESCRIPTION OF THE DRAWING FIGURES

Further features of the adjustable box top lid are set forth in the following detailed description of the preferred embodiment of the lid and in the drawing figures.

DETAILED DESCRIPTION OF THE PREFERRED EMBODIMENT

Figure 1:
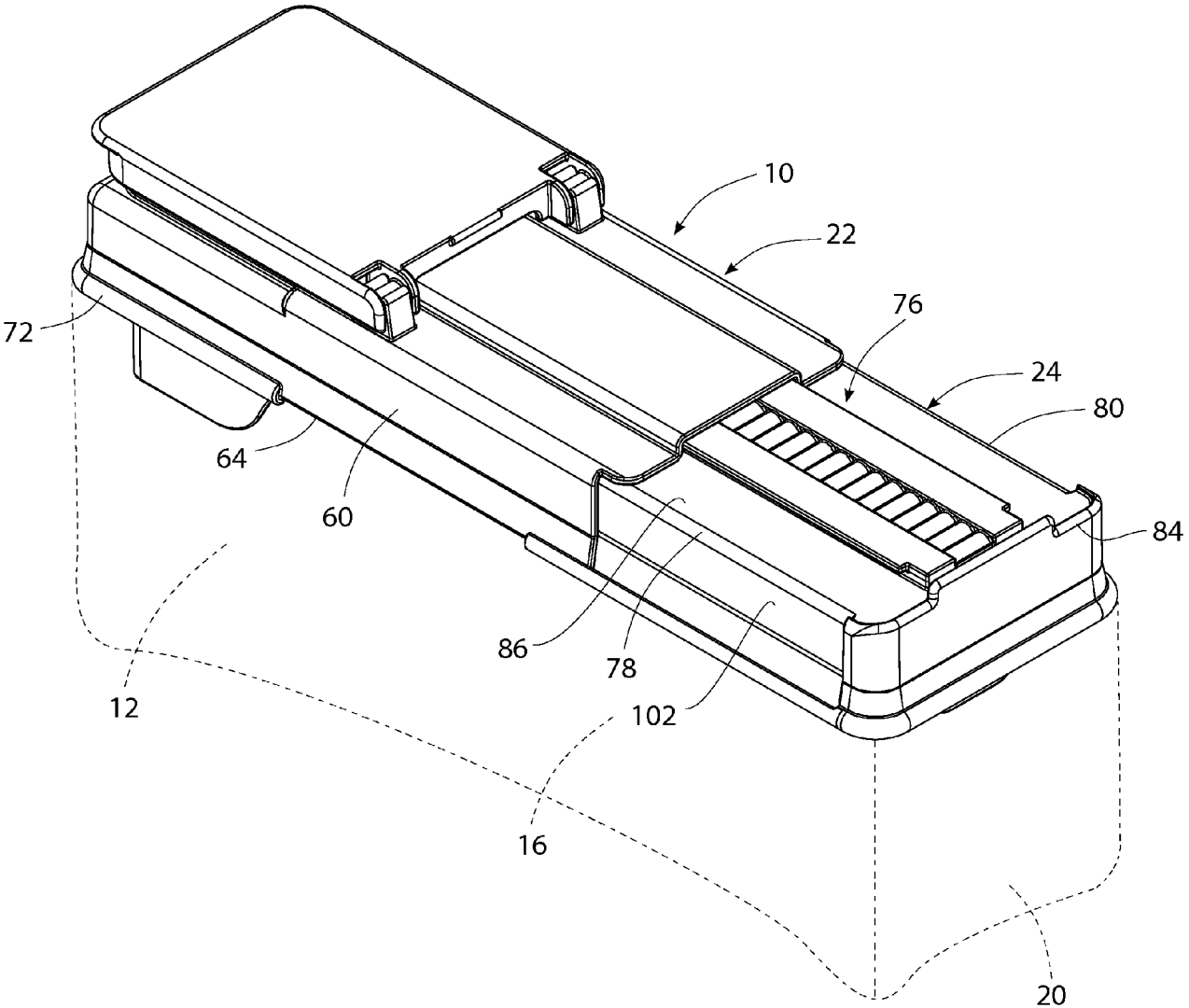
FIG. 1 is a perspective view of the adjustable box top lid removably attached over the rectangular top opening of a larger container which is represented in dashed lines.
Figure 2:
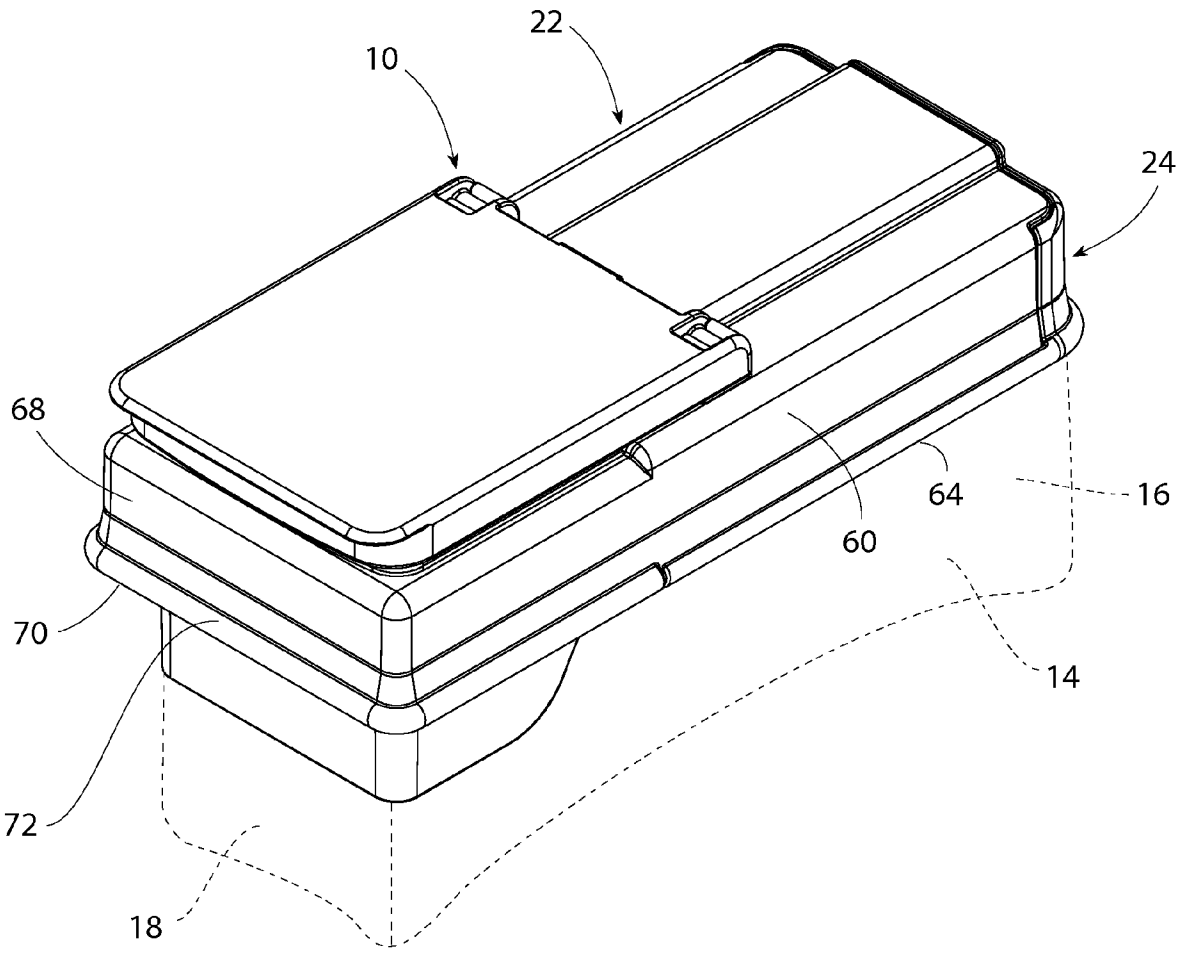
FIG. 2 is a perspective view of the adjustable box top lid removably attached over the rectangular top opening of a smaller container which is represented in dashed lines.
Figure 3:
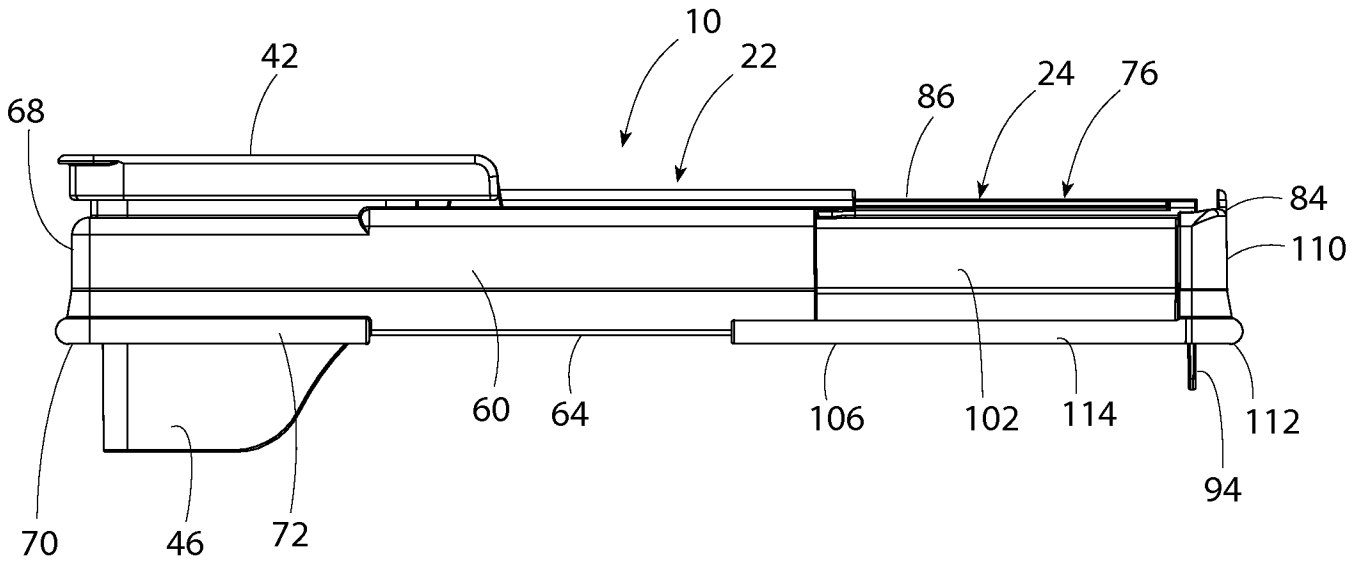
FIG. 3 is a side elevation view of the lid at its longer adjusted length, the opposite side of the lid being a mirror image thereof.
Figure 4:
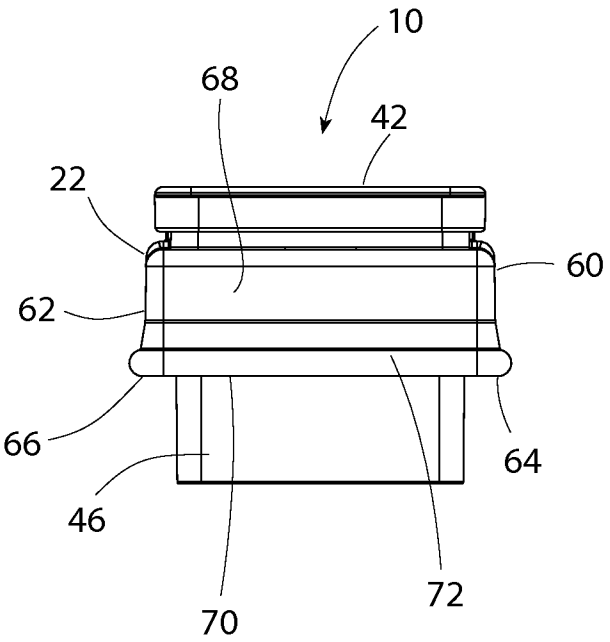
FIG. 4 is a front elevation view of the lid.
Figure 5:
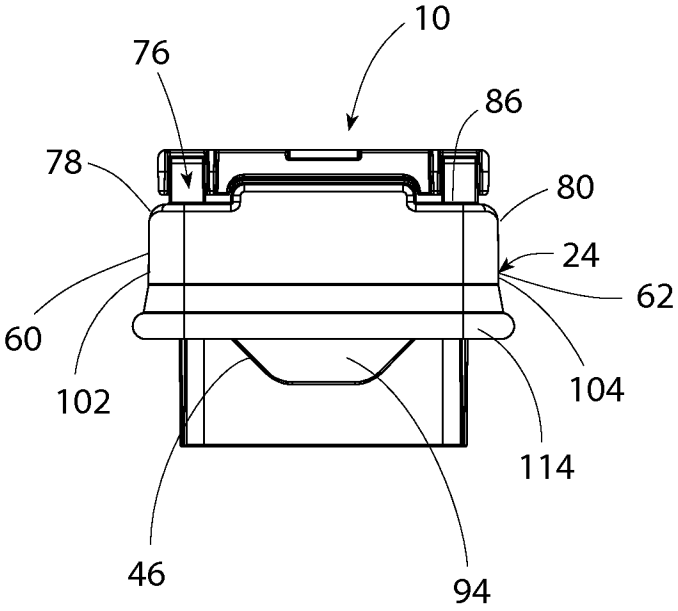
FIG. 5 is a rear elevation view of the lid.
Figure 6:
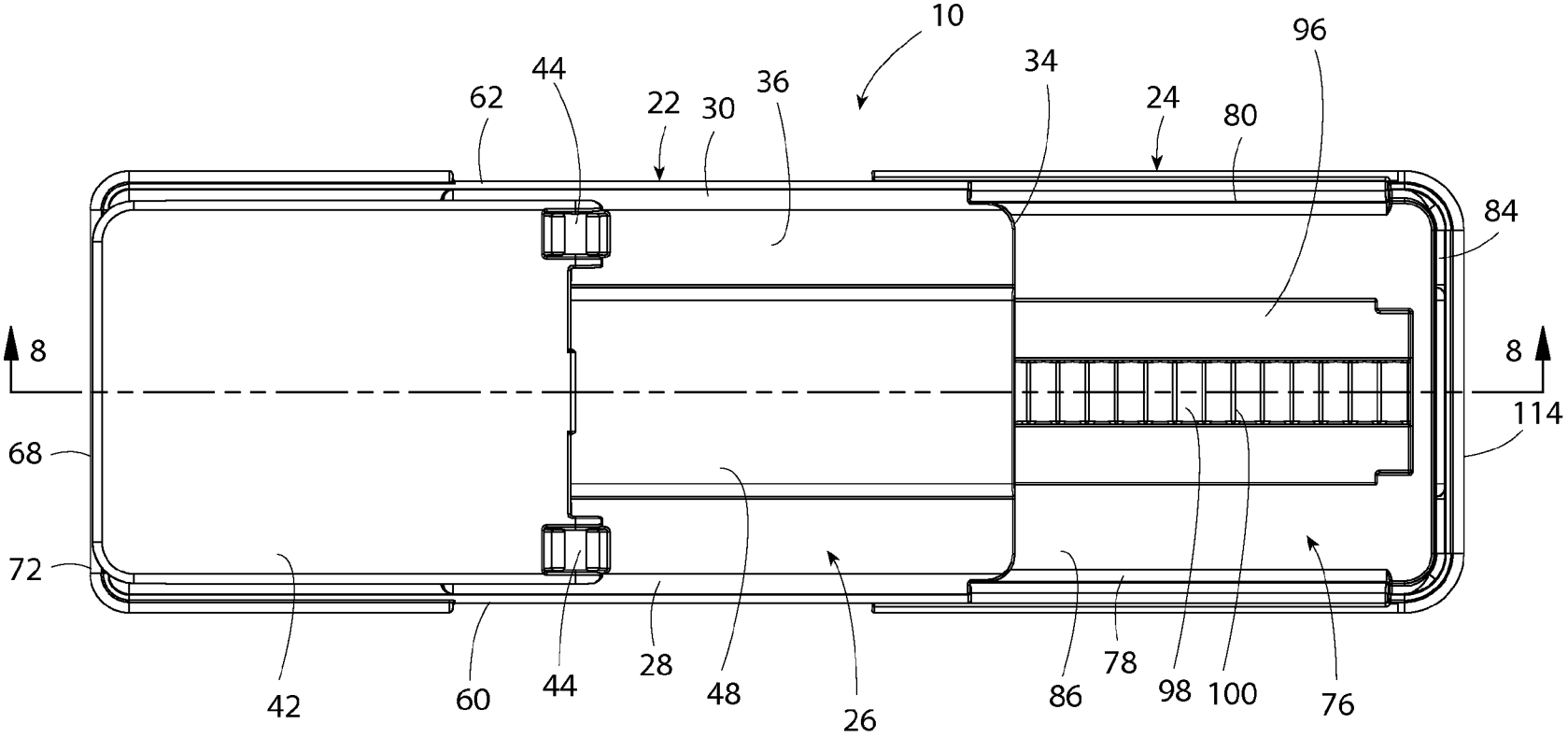
FIG. 6 is a top plan view of the lid.
Figure 7:
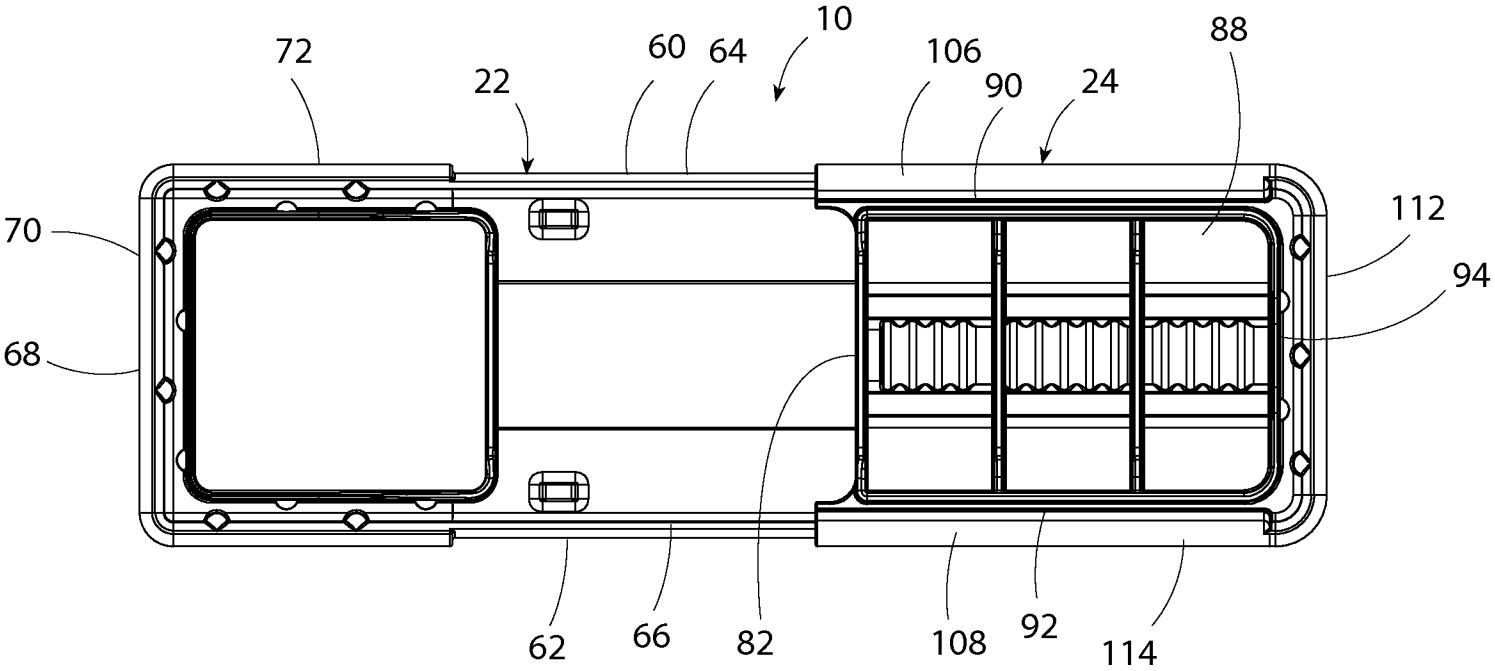
FIG. 7 is a bottom plan view of the lid.
Figure 8:
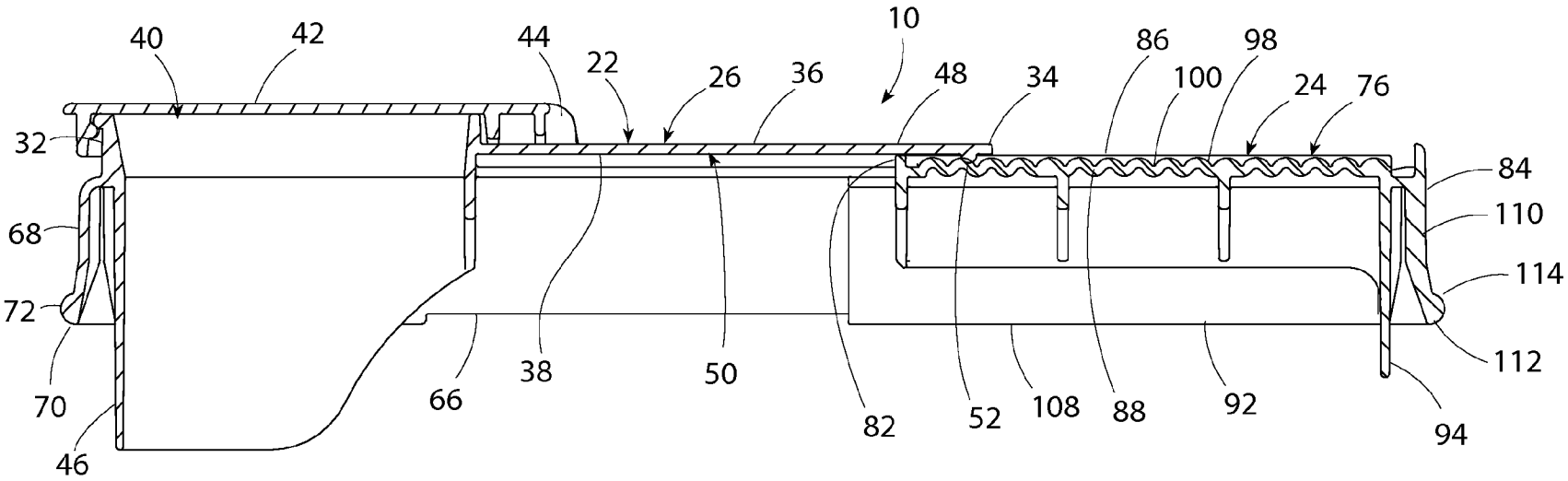
FIG. 8 is a side cross-section view of the lid along the line 8-8 of FIG. 6.
Figure 9:
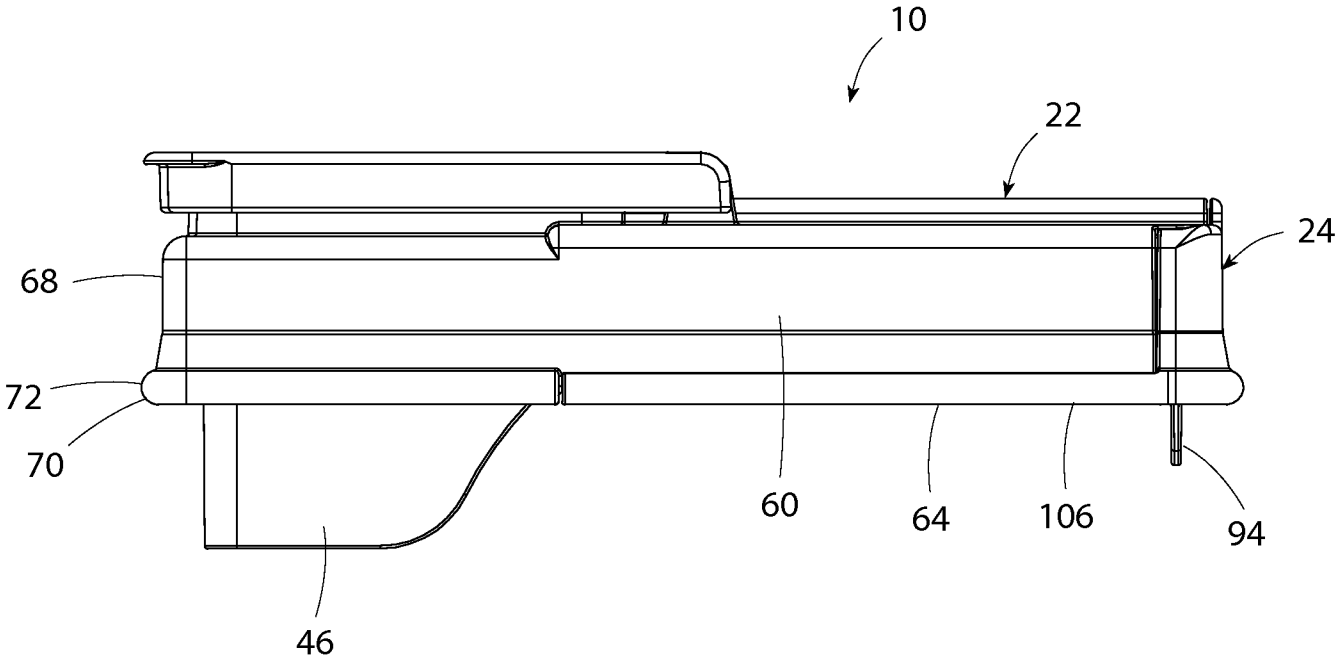
FIG. 9 is a side elevation view of the lid at its shorter adjusted length the opposite side of the lid being a mirror image thereof.
Figure 10:
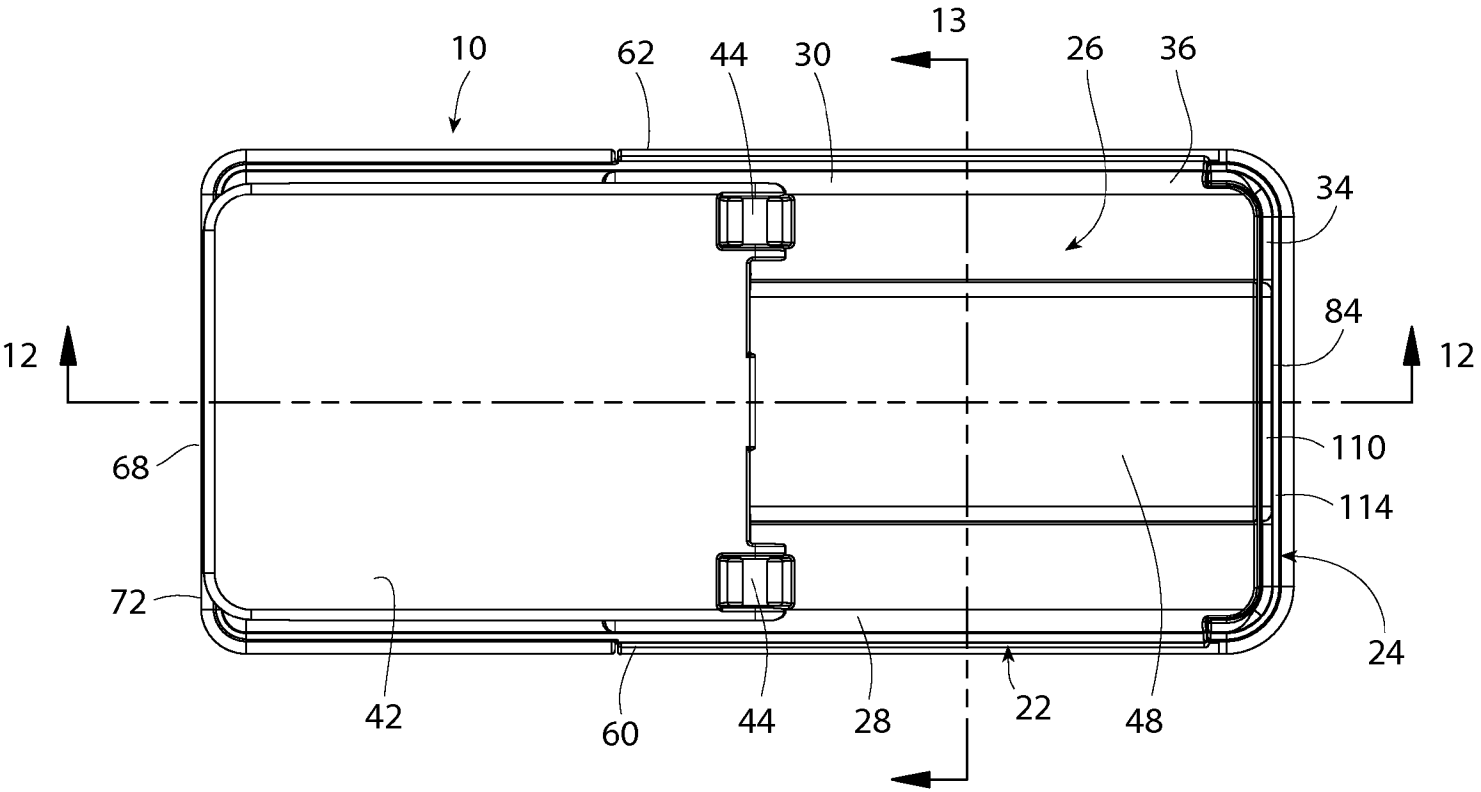
FIG. 10 is a top plan view of the lid of FIG. 9.

FIGS. 1 and 2 are perspective views of the adjustable box top lid 10. In FIG. 1 the lid 10 is shown removably attached to the open top of a packaging box 12 with the lid 10 in its larger adjusted length configuration. In FIG. 2 the lid 10 is shown removably attached to the open top of a packaging box 14 with the lid 10 adjusted to its smaller length configuration. The lid 10 is constructed of a resilient plastic material that facilitates its attachment to the open top of the boxes 12, 14 of various different sizes. The large box 12 and the small box 14 shown in FIGS. 1 and 2, respectively, are only two examples of the various different sizes of boxes that are presently employed in packaging food products such as breakfast cereals to which the lid 10 may be attached.

Only the upper portions of the boxes 12, 14 are shown in dashed lines in FIGS. 1 and 2. Each box 12, 14 is basically comprised of closed bottom flaps (not shown), a front wall 16 that typically displays the trademark of the product contained in the box, an opposite back wall (not shown), a first side wall 18 and a second, opposite side wall 20. As stated earlier, in the various different sizes of product boxes available, the length dimensions of the front wall 16 and back wall (not shown) vary significantly. The differences in the length dimensions of the side walls 18, 20 of the different sizes of product boxes is not as substantial as the differences in the length dimensions of the front and rear walls. The adjustable lid 10 shown in FIG. 1 is attached to the open top of a larger box 12 where the four flaps on the box top have been folded over or removed, exposing top edges of the front 16 and back walls and the first 18 and second 20 side walls. The adjustable lid 10 shown in FIG. 2 is attached over the top of a smaller box 14 where the four flaps on the box top have been folded down or removed, exposing the top edges of the front 16 and back walls and the first 18 and second 20 side walls.

The adjustable box top lid 12 has a first 22 and second 24 separate sections that are connected together and are movable relative to each other when connected to adjust a length of the lid. The adjustable length of the lid 10 enables the lid to fit over the top opening of each container 12, 14 of a plurality of separate containers where the length dimensions of the open top of each container is different from the length dimensions of the open tops of the other containers.

The lid first section 22 has a rectangular first panel 26 with opposite left 28 and right 30 edges and opposite front 32 and rear 34 edges. The edges 28, 30, 32, 34 surround the first panel 24, separate a top surface 36 of the first panel from an opposite bottom surface 38 of the first panel, and give the first panel 26 its rectangular configuration. A dispensing opening 40 passes through the first panel 26 adjacent the first panel front edge 32. As shown in the drawing figures, the opening 40 has a generally rectangular or square configuration. A generally rectangular cap 42 is connected by a pair of hinges 44 to the first panel top surface 36. The cap 42 is dimensioned to pivot to a closed position over the opening 40 and pivot away from the opening to an open position of the cap. A bag securing apron 46 projects outwardly from the first panel bottom surface 38. As seen in the drawing figures, the apron 46 extends around three sides of the dispensing opening 40. The dispensing opening 40, the cap 42, the hinges 44 and the bag securing apron 46 are similar to those of the lid disclosed in the U.S. Pat. No. 5,884,800 to Hall, incorporated herein by reference.

Figure 11:
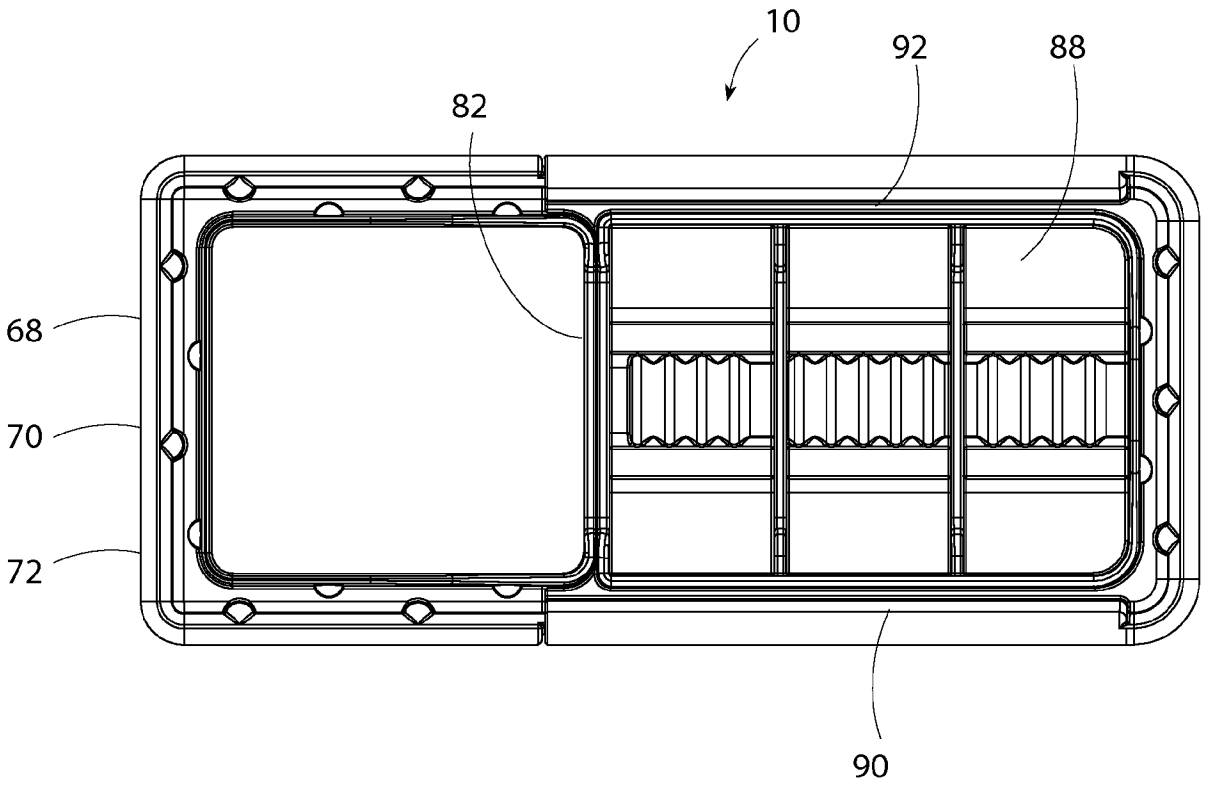
FIG. 11 is a bottom plan view of the lid of FIG. 9.
Figure 12:
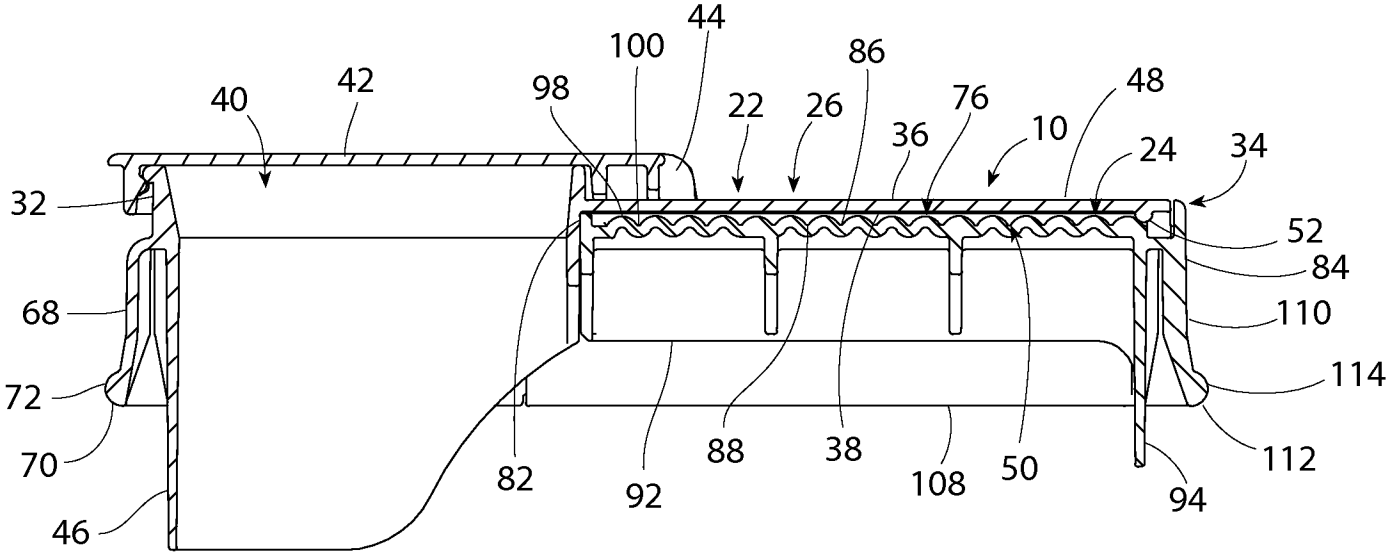
FIG. 12 is a side cross-section view of the lid of FIG. 10 along the line 12-12 in FIG. 10.
Figure 13:
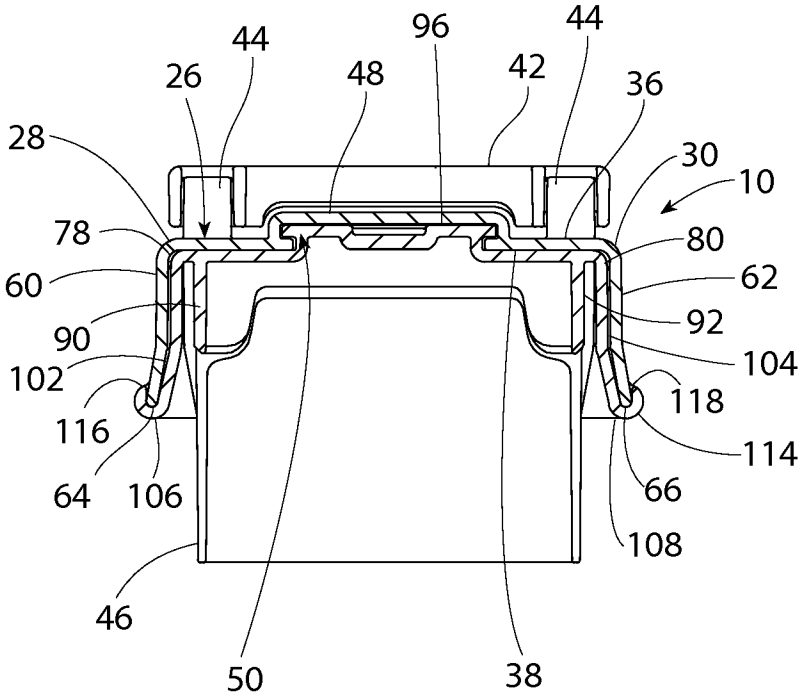
FIG. 13 is a cross-section view of the lid along the line 13-13 of FIG. 10.
Figure 14:
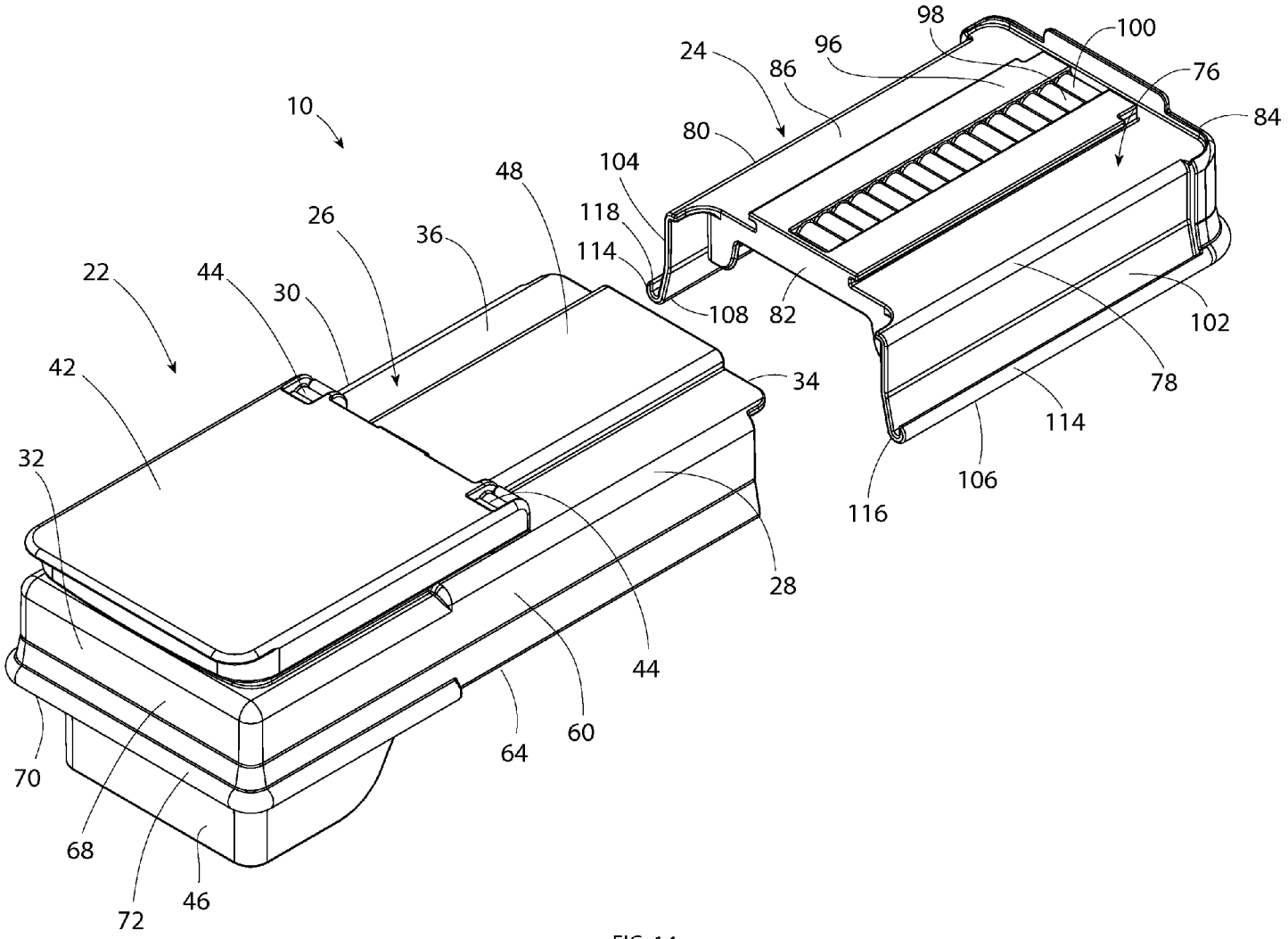
FIG. 14 is a perspective view of the lid separated into its two sections.

The first panel 26 also has a rectangular raised portion 48 that extends from the rear edge 34 of the panel to the dispensing opening 40. The raised portion 48 forms a rectangular cavity 50 in the first panel bottom surface 38. In the embodiment of the lid 10 shown in the drawings the cavity 50 forms a mortise. The mortise has a T-shaped cross section in the first panel bottom surface 38 as shown in FIG. 11. A narrow tab 52 projects from the first panel bottom surface 38 at the center of the cavity 50 and adjacent the first panel rear edge 34.

The first section 22 also has left 60 and right 62 side panels that extend outwardly from the first panel bottom surface 38. As seen in the drawing figures, the side panels 60, 62 extend along the respective left 28 and right 30 edges of the first panel 26. The left side panel 60 extends outwardly from the first panel bottom surface 38 to a bottom edge 64 of the left side panel. The left side panel bottom edge 64 is substantially parallel to the first panel left edge 28 and extends along the length of the left side panel 60. The right side panel 62 extends outwardly from the first panel bottom surface 38 to a bottom edge 66 of the right side panel. The right side panel bottom edge 66 is substantially parallel to the first panel right edge 30 and extends along the length of the right side panel.

The first section 22 also has a front panel 68 that extends outwardly from the first panel bottom surface 38. The front panel 68 extends along the first panel front edge 32. Opposite sides of the front panel 68 merge into the left side panel 60 and right side panel 62. The front panel 68 extends outwardly from the first panel bottom surface 38 to a bottom edge 70 of the front panel. A projecting bead or rim 72 is formed along the bottom edge of the front panel 70 and along portions of the bottom edges of the left side panel 64 and the right side panel 66.

The lid first section 22 has a width dimension between the left 28 and right 30 edges and between the left 60 and right 62 side panels that enables the first panel 26 to fit over the top opening and one of the sidewalls 18 of the each container 12, 14 of the plurality of separate containers.

The lid second section 24 has a rectangular second panel 76 with opposite left 78 and right 80 edges and opposite front 82 and rear 84 edges. The edges 78, 80, 82, 84 surround the second panel 76, separate a top surface 86 of the second panel from an opposite bottom surface 88 of the second panel 76, and give the second panel its rectangular configuration. A bag securing apron comprised of left 90 and right 92 side walls and a rear wall 94 projects outwardly from the second panel bottom surface 88. The left side wall 90 is positioned just inside the left edge 78 of the second panel 76, the right side wall 92 is positioned just inside of the right edge 88 of the second panel 76, and the rear wall 94 is positioned just inside of the rear edge 84 of the second panel.

The second panel 76 also has a raised portion 96 on the top surface 86 of the second panel. The raised portion 96 has a general rectangular configuration that extends along the length of the second panel top surface 86 from adjacent the top surface rear edge 84 to the top surface front edge 82. The raised portion 96 is formed as a tenon that engages in the mortise formed by the cavity 50 in the first panel bottom surface 38. In viewing the cross-section view of FIG. 11 it can be seen that the raised portion 96 has a general T-shaped configuration in cross-section. The T-shaped cross-section of the raised portion 96 fits into the T-shaped cross-section of the first panel cavity 50 to form a dovetail connection between the first section 22 and the second section 24 of the lid. This connection enables the lid first 22 and second 24 sections to move relative to each other while connected to adjust the length of the lid 10. The second panel raised portion 96 also has a series of ridges 98 and troughs 100 formed in the top surface of the raised portion. The ridges 98 and troughs 100 are centered in the raised portion 96 and arranged in alternating positions along the length of the raised portion. The ridges 98 and troughs 100 have widths that are dimensioned to receive the tab 52 in the cavity 50 of the first panel bottom surface 38. As the lid first 22 and second 24 sections are adjustably positioned relative to each other along the length of the lid 10, the tab 52 engages over the ridges 98 and into the troughs 100 to secure the lid first 22 and second 24 sections in their adjusted positions.

The lid second section 24 also has left 102 and right 104 side panels that extend outwardly from the second panel bottom surface 88. The left 102 and right 104 side panels extend along the respective second panel left 78 and right 80 edges. The left side panel 102 extends outwardly from the second panel bottom surface 88 to a bottom edge 106 of the left side panel. The left side panel bottom edge 106 is substantially parallel with the second panel left edge 78. The right side panel 104 extends outwardly from the second panel bottom surface 88 to a bottom edge 108 of the right side panel. The right side panel bottom edge 108 is substantially parallel with the second panel right edge 80.

The second section 24 also has a rear panel 110 that projects outwardly from the second panel bottom surface 88 and extends along the second panel rear edge 84. Opposite ends of the rear panel 110 merge into the left side panel 102 and the right side panel 104. The rear panel 110 extends outwardly from the second panel bottom surface 88 to a bottom edge 112 of the rear panel. The rear panel bottom edge 112 is positioned parallel with the second panel rear edge 84.

A projecting rim or bead 114 extends along the rear panel bottom edge 112 and along the left side panel bottom edge 106 and the right side panel bottom edge 108. As shown in FIG. 11, the portions of the bead 114 along the left side panel bottom edge 106 and the right side panel bottom edge 108 have respective channels 116, 118. The first section left side panel bottom edge 64 is received in sliding engagement in the second section left side panel bottom edge channel 116 and the first section right side panel bottom edge 66 is received in sliding engagement in the second section right side panel bottom edge channel 118. This sliding engagement further secures the lid first section 22 and second section 24 together for relative movement along the lid length.

As stated earlier, the lid first 22 and second 24 sections are connected together for relative movement of the first and second sections. The connected first 22 and second 24 sections are movable along the length of the lid with the first panel bottom surface 38 sliding over the second panel top surface 86 and the first section left side panel 60 and right side panel 62 sliding over the respective second section left side panel 102 and right side panel 104. The relative movement of the lid first 22 and second 24 sections enables adjusting the length of the lid. The adjustable length of the lid enables the lid to fit over the top opening of each container of the plurality of containers.

With the adjusted length of the lid 10 removably attached over the top opening of a container such as the large container 12 shown in FIG. 1 and the small container 14 shown in FIG. 2, or any other size container, the container front wall 16 is securely held between the first section left side panel 60 and the opposing portion of the apron 46, the container rear wall (not shown) is securely held between the first section right side panel 62 and the opposing portion of the apron 46, and the container first sidewall 18 is securely held between the first section front panel 68 and the opposing portion of the apron 46.

Additionally, the container front wall 16 is securely held between the second section left side panel 102 and the apron left side wall 90, the container rear wall (not shown) is securely held between the second section right side panel 104 and the apron right sidewall 92, and the container second sidewall 20 is securely held between the second section rear panel 110 and the apron rear wall 94.

Thus, the adjustable box top lid provides a lid that can be removably attached to the opened box top of product packaging boxes of various different sizes where the lid can be easily opened to dispense the desired amount of product from the box and then can be easily closed to preserve the product.

As various modifications could be made in the construction of the apparatus and its method of use herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

What is claimed is:

1. An adjustable lid that is removably attachable to each container of a plurality of separate containers with each container having a rectangular top opening with a length dimension that is different from length dimensions of the openings of the other containers of the plurality of separate containers, the lid comprising:

first and second separate sections that are connected to form the lid and are movable relative to each other when connected to adjust a length of the lid;

a rectangular first panel on the first section, the first panel having opposite left and right edges and opposite front and rear edges that surround the first panel and separate a top surface of the first panel from an opposite bottom surface of the first panel;

a rectangular second panel on the second section, the second panel having opposite left and right edges and opposite front and rear edges that surround the second panel and separate a top surface of the second panel from an opposite bottom surface of the second panel;

the first panel having a mortise on the first panel bottom surface, the mortise having a length oriented along the length of the lid;

the second panel having a tenon on the second panel top surface, the tenon having a length oriented along the length of the lid, the tenon extending into the mortise and thereby connecting the lid first and second sections for relative movement of the lid first and second sections along the length of the lid and thereby adjusting the length of the lid and enabling the lid to fit over the top opening of each container of the plurality of separate containers with the first panel front edge and the second panel rear edge extending over opposite ends of the container opening;

the first panel having a width between the left and right edges of the first panel that is dimensioned to fit the first panel width over the top opening of each container of the plurality of separate containers;

the second panel having a width between the left and right edges of the second panel that is dimensioned to fit the second panel width over the top opening of each container of the plurality of separate containers;

an opening through the first panel;

a cap removably attached on the first panel top surface over the opening;

the first panel having a rectangular raised portion that extends from the rear edge of the first panel toward the opening through the first panel, the raised portion forming a rectangular cavity in the first panel bottom surface, the rectangular cavity forming the mortise on the first panel bottom surface;

a narrow tab projecting from the first panel bottom surface at the center of the rectangular cavity and adjacent the first panel rear edge;

the second panel having a rectangular raised portion that extends from the front edge of the second panel toward the rear edge of the second panel, the raised portion of the second panel forming the tenon that extends into the mortise; and, a series of ridges and troughs formed on the raised portion of the second panel, the ridges and troughs having widths that are dimensioned to receive the tab in the cavity of the first panel where as the first section and second section of the lid are adjustably positioned relative to each other to adjust the length of the lid, the tab engages over the ridges and into the troughs to secure the first section and the second section of the lid in their adjusted positions.

2. The lid of claim 1, further comprising:

the mortise having a general T-shaped cross-section; and, the tenon having a general T-shaped cross-section.

3. The lid of claim 1, further comprising:

the tenon extending into the mortise forming a dovetail connection between the first and second sections.

4. The lid of claim 1, further comprising:

the opening through the first panel being the only opening through the first and second panels.

5. The lid of claim 1, further comprising:

the first panel bottom surface and the second panel top surface engaging in sliding contact.

6. An adjustable lid that is removably attachable to each container of a plurality of separate containers with each container having a rectangular top opening with a length dimension that is different from length dimensions of the openings of the other containers of the plurality of separate containers, the lid comprising:

first and second separate sections that are connected to form the lid and are movable relative to each other when connected to adjust a length of the lid;

a rectangular first panel on the first section, the first panel having opposite left and right edges and opposite front and rear edges that surround the first panel and separate a top surface of the first panel from an opposite bottom surface of the first panel;

left and right side panels on the first section, the left and right side panels extending outwardly from the first panel bottom surface along the respective left and right edges of the first panel;

a front panel on the first section, the front panel extending outwardly from the first panel bottom surface along the front edge of the first panel;

a rectangular second panel on the second section, the second panel having opposite left and right edges and opposite front and rear edges that surround the second panel and separate a top surface of the second panel from an opposite bottom surface of the second panel;

left and right side panels on the second section, the left and right side panels extending outwardly from the second panel bottom surface along the respective left and right edges of the second panel;

a rear panel on the second section, the rear panel extending outwardly from the second panel bottom surface along the rear edge of the second panel;

the first panel having a mortise on the first panel bottom surface, the mortise having a length oriented along the length of the lid;

the second panel having a tenon on the second panel top surface, the tenon having a length oriented along the length of the lid, the tenon extending into the mortise and thereby connecting the lid first and second sections for relative movement of the lid first and second sections along the length of the lid and thereby adjusting the length of the lid and enabling the lid to fit over the top opening of each container of the plurality of separate containers with the first panel front edge and the second panel rear edge extending over opposite side walls of the container top opening and with the left side panels of the first and second sections and the right side panels of the first and second sections extending over opposite front and rear walls of the container opening;

the first panel having a width between the left and right edges of the first panel that is dimensioned to fit the first panel width over the top opening of each container of the plurality of separate containers;

the second panel having a width between the left and right edges of the second panel that is dimensioned to fit the second panel width over the top opening of each container of the plurality of separate containers;

an opening through the first panel;

a cap removably attached on the first panel top surface over the opening;

the first panel having a rectangular raised portion that extends from the rear edge of the first panel toward the opening through the first panel, the raised portion forming a rectangular cavity in the first panel bottom surface, the rectangular cavity forming the mortise on the first panel bottom surface;

a narrow tab projecting from the first panel bottom surface at the center of the rectangular cavity and adjacent the first panel rear edge;

the second panel having a rectangular raised portion that extends from the front edge of the second panel toward the rear edge of the second panel, the raised portion of the second panel forming the tenon that extends into the mortise; and, a series of ridges and troughs formed on the raised portion of the second panel, the ridges and troughs having widths that are dimensioned to receive the tab in the cavity of the first panel where as the first section and second section of the lid are adjustably positioned relative to each other to adjust the length of the lid, the tab engages over the ridges and into the troughs to secure the first section and the second section of the lid in their adjusted positions.

7. The lid of claim 6, further comprising:

the mortise having a general T-shaped cross-section; and, the tenon having a general T-shaped cross-section.

8. The lid of claim 6, further comprising:

the tenon extending into the mortise forming a dovetail connection between the first and second sections.

9. The lid of claim 6, further comprising:

the opening through the first panel being the only opening through the first and second panels.

10. The lid of claim 6, further comprising:

the first panel bottom surface and the second panel top surface engaging in sliding contact.

11. An adjustable lid that is removably attachable to each container of a plurality of separate containers with each container having a rectangular top opening with a length dimension that is different from length dimensions of the openings of the other containers of the plurality of separate containers, the lid comprising:

first and second separate sections that are connected to form the lid and are movable relative to each other when connected to adjust a length of the lid;

a rectangular first panel on the first section, the first panel having opposite left and right edges and opposite front and rear edges that surround the first panel and separate a top surface of the first panel from an opposite bottom surface of the first panel;

left and right side panels on the first section, the left and right side panels extending outwardly from the first panel bottom surface along the respective left and right edges of the first panel;

a front panel on the first section, the front panel extending outwardly from the first panel bottom surface along the front edge of the first panel;

a rectangular second panel on the second section, the second panel having opposite left and right edges and opposite front and rear edges that surround the second panel and separate a top surface of the second panel from an opposite bottom surface of the second panel;

left and right side panels on the second section, the left and right side panels extending outwardly from the second panel bottom surface along the respective left and right edges of the second panel;

a rear panel on the second section, the rear panel extending outwardly from the second panel bottom surface along the rear edge of the second panel;

the first panel having a mortise on the first panel bottom surface, the mortise having a length oriented along the length of the lid;

the second panel having a tenon on the second panel top surface, the tenon having a length oriented along the length of the lid, the tenon extending into the mortise and thereby connecting the lid first and second sections for relative movement of the lid first and second sections along the length of the lid and thereby adjusting the length of the lid and enabling the lid to fit over the top opening of each container of the plurality of separate containers with the first panel front edge and the second panel rear edge extending over opposite side walls of the container top opening and with the left side panels of the first and second sections and the right side panels of the first and second sections extending over opposite front and rear walls of the container opening;

the left and right side panels of one of the first and second sections having U-shaped channels formed at bottoms of the side panels and the left and right side panels of the other of the first and second sections engaging in the U-shaped channels for sliding movement in the U-shaped channels along the length of the lid;

the first panel having a width between the left and right edges of the first panel that is dimensioned to fit the first panel width over the top opening of each container of the plurality of separate containers;

the second panel having a width between the left and right edges of the second panel that is dimensioned to fit the second panel width over the top opening of each container of the plurality of separate containers;

an opening through the first panel;

a cap removably attached on the first panel top surface over the opening;

the first panel having a rectangular raised portion that extends from the rear edge of the first panel toward the opening through the first panel, the raised portion forming a rectangular cavity in the first panel bottom surface, the rectangular cavity forming the mortise on the first panel bottom surface;

a narrow tab projecting from the first panel bottom surface at the center of the rectangular cavity and adjacent the first panel rear edge;

the second panel having a rectangular raised portion that extends from the front edge of the second panel toward the rear edge of the second panel, the raised portion of the second panel forming the tenon that extends into the mortise; and, a series of ridges and troughs formed on the raised portion of the second panel, the ridges and troughs having widths that are dimensioned to receive the tab in the cavity of the first panel where as the first section and second section of the lid are adjustably positioned relative to each other to adjust the length of the lid, the tab engages over the ridges and into the troughs to secure the first section and the second section of the lid in their adjusted positions.

12. The lid of claim 11, further comprising:

the tenon extending into the mortise forming a dovetail connection between the first and second sections.

13. The lid of claim 11, further comprising:

the first panel bottom surface and the second panel top surface engaging in sliding contact.

* * * * *